United States Patent [19]

Schubert

[11] Patent Number: 4,815,311

[45] Date of Patent: Mar. 28, 1989

[54] FORGING MANIPULATOR

[75] Inventor: Peter Schubert, Kaarst, Fed. Rep. of Germany

[73] Assignee: SMS Hasenclever Maschinenfabrik GmbH, Dusseldorf, Fed. Rep. of Germany

[21] Appl. No.: 79,892

[22] Filed: Jul. 31, 1987

[30] Foreign Application Priority Data

Jul. 31, 1986 [DE] Fed. Rep. of Germany ..... 3626090

[51] Int. Cl.[4] ..... B21J 13/10

[52] U.S. Cl. ..... 72/420; 72/422; 414/621

[58] Field of Search ..... 72/420, 422; 414/619, 414/620, 621, 622

[56] References Cited

U.S. PATENT DOCUMENTS

| | | | |
|---|---|---|---|
| 2,257,546 | 9/1941 | Dienenthal et al. | 414/620 |
| 3,126,770 | 3/1964 | Wuppermann et al. | 72/420 |
| 3,370,452 | 2/1968 | Sack et al. . | |
| 3,498,490 | 3/1970 | Schussler et al. . | |

FOREIGN PATENT DOCUMENTS

| | | | |
|---|---|---|---|
| 972409 | 7/1959 | Fed. Rep. of Germany . | |
| 1300092 | 7/1969 | Fed. Rep. of Germany . | |
| 1527363 | 8/1969 | Fed. Rep. of Germany . | |
| 1926638 | 11/1970 | Fed. Rep. of Germany . | |
| 1298497 | 7/1973 | Fed. Rep. of Germany . | |
| 2255009 | 5/1974 | Fed. Rep. of Germany . | |
| 1459361 | 11/1966 | France | 72/422 |
| 50943 | 4/1980 | Japan | 72/420 |
| 614875 | 7/1978 | U.S.S.R. | 72/422 |
| 1315143 | 4/1973 | United Kingdom . | |
| 1410696 | 10/1975 | United Kingdom . | |

*Primary Examiner*—Lowell A. Larson
*Attorney, Agent, or Firm*—Holman & Stern

[57] ABSTRACT

A forging manipulator has a billet gripper carrier rotatable about its longitudinal axis in bearings, which in turn are displaceable transversally along cross arms on a carriage. To reduce height and to reduce bending moments, the cross arms are above the bearings and above the gripper carrier, which are suspended from the cross arms. The cross arms are raised and lowered, by telescopic piston and cylinder units which support the cross arms on the upper ends of the cylinders, the piston rods being suspended on the carriage.

12 Claims, 3 Drawing Sheets

FORGING MANIPULATOR

BACKGROUND OF THE INVENTION

1. Field of the Invention

This invention relates to manipulators for handling heavy workpieces undergoing forging operations.

2. Description of the Prior Art

In order to manipulate heavy forged pieces, forging manipulators are used whose gripper which holds the forged piece is adapted for raising, lowering, horizontal and vertical pivoting, lateral parallel displacement, turning and axial movement. For this purpose known forging manipulators are provided with bearings supported in a travelling frame or carriage by connecting rods for a gripper carrier which is rotatable in the bearings. The connecting rods are telescopic piston-cylinder units connected by a ball-and-socket joint at one end to vertically displaceably forks pivotable in the travelling frame and at the other and to cross arms supporting the bearings of the gripper carrier, the gripper carrier with its bearings being horizontally displaceable on the cross arms. The design of the telescopic connecting rods, which are formed by integrated piston-cylinder units and which with the pair of connecting rods adjacent the gripper head are adapted for vertical springing and with the rear pair of connecting rods are adapted for setting the inclination of the gripper carrier, in order to prevent excessive loading of the bearings and to ensure movement of the forged piece between the forging tools of the press without contact or with slight thrust pressure, has resulted in the cross arms which support the gripper carrier with its bearings being arranged below the bearings (West German Patent No. DE-PS 22 55009, corresponding to British Patent Specification No. 1,410,696). An advantage of this arrangement is also that relatively long connecting rods are involved, so that their angles of deflection remain small during a predetermined longitudinal or transverse movement of the gripper carrier (West German Patent No. DE-PS 12 98 497 corresponding to U.S. Pat. No. 3,498,490).

On account of the saddle height of the lower forging tool, it should be possible for the gripper carrier to be lowered as closely as possible to the shop floor in its lower position and if the distance from the shop floor to the center of the gripper carrier is not sufficient for receiving the bearings with the associated cross arm, the bearings and the cross arm have been moved towards one another in the direction of the axis of the gripper carrier, with the disadvantage that the housing receiving the bearings of the gripper carrier and connecting the latter is subject to the bending moments which result from the bearing pressures and the displacement of the cross arm towards the bearings.

BRIEF SUMMARY OF THE INVENTION

The object of the invention is, in a forging manipulator which has bearings for the gripper carrier which are displaceable transversely along cross arms, to prevent bending moments in the component connecting the bearings when the gripper carrier is arranged close above the shop floor, even when the diameter of the bearing of the gripper carrier disposed close to the gripper approaches the diameter of the gripper.

In order to attain this object, the invention provides that the cross arms, which support the bearings for the gripper carrier and along which the bearings are transversely displaceable, are disposed above the bearings in the respective median plane of the bearings.

West German Patent No. DE-PS 15 27 362, corresponding to U.S. Pat. No. 3,370,452, discloses the suspension of the bearings of a gripper carrier in the travelling frame by means of swing arms, the connection between the swing arms and bearings being provided in the respective median plane of the bearings. The suspension by way of swing arms allows the gripper carrier to be supported in a yielding manner in the axial direction, without a transverse movement of the gripper carrier, its vertical setting, the setting of its inclination and its vertical spring loading being provided, or possible.

The arrangement of the cross arms above the bearings of the gripper carrier in the respective median plane of the bearings, as provided according to the invention, leads however to a correspondingly substantial overall height of the manipulator, if the connecting rods with the integrated piston-cylinder units are constructed in the manner of a telescope and are thus adapted for the vertical spring loading and setting of the inclination of the gripper carrier. A further object of the invention is to avoid an increase in the overall height ofthe manipulator.

According to a further feature of the invention, therefore, the piston-cylinder units integrated with the connecting rods comprise piston rods which form extensions of the connecting rods and have pistons and cylinders, which are traversed by the piston rods, guided on the latter, formed as supports of the cross arms and disposed below the cross arms. The connecting rods and piston rods can be connected to one another by ball-and-socket joints.

According to a further feature of the invention, the piston-cylinder units are provided with spherical collars to support end pieces of the cross arms by way of interposed ball sockets and the piston rods, extended to form the connecting rods, are guided with clearance through bores in the end pieces of the cross arms. This provides a structural simplification with the center point of the spherical collars and ball sockets situated below the support, and a correspondingly great effective length of the connecting rods, which is a further advantage.

BRIEF DESCRIPTION OF THE DRAWINGS

One embodiment of the invention will now be described in detail with reference to the accompanying drawings wherein.

DETAILED DESCRIPTION

Figure 1:
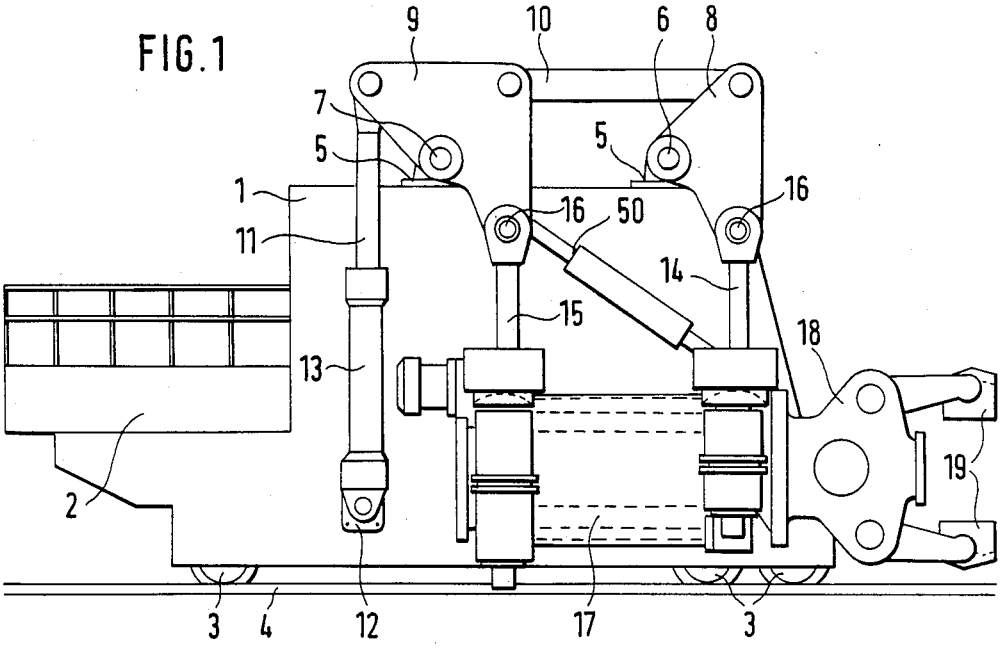
FIG. 1 is a general elevational view of the manipulator of the invention.
Figure 2A:
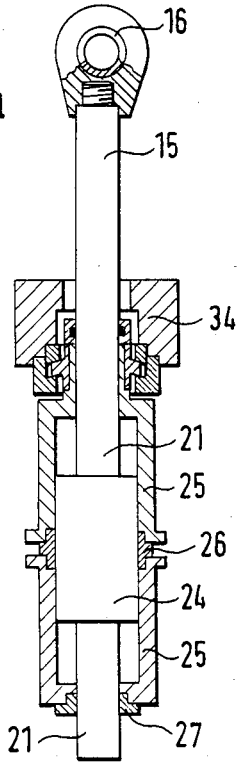
FIG. 2*a* as a longitudinal cross-sectional view on an enlarged scale of one of the rear connecting rods, and shown in FIG. 1.
Figure 2B:
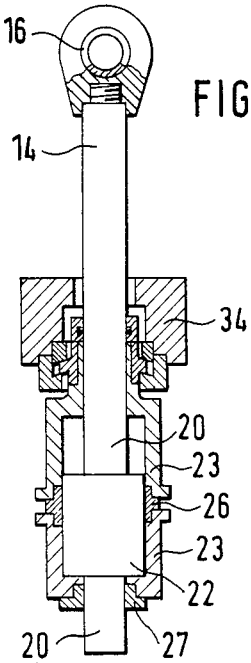
FIG. 2*b* as a longitudinal cross-sectional view on an enlarged scale of one of the front connecting rods shown in FIG. 1.
Figure 3:
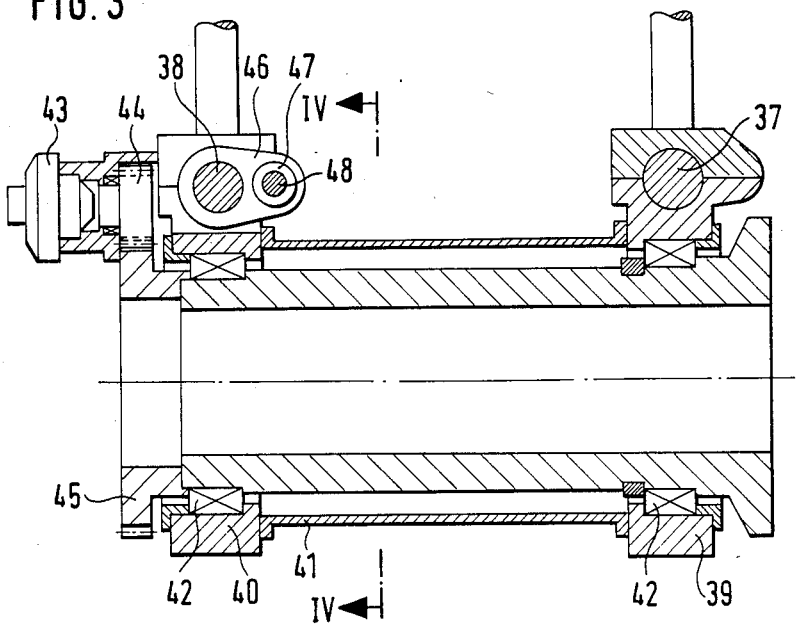
FIG. 3 is a longitudinal cross-sectional view of the gripper support with its mounting taken along the lines III—III in FIG. 4.
Figure 4:
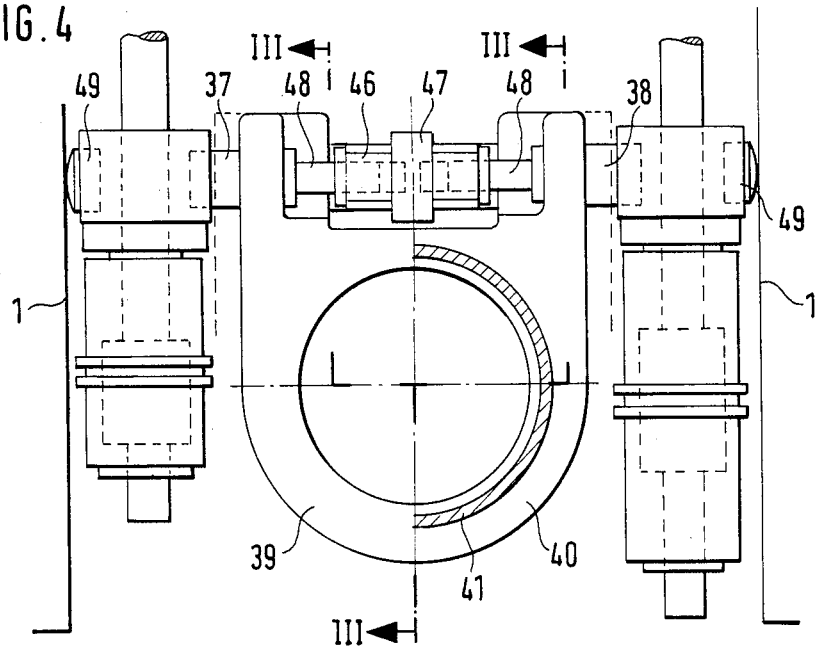
FIG. 4 is a partly front elevational view of the mounting of the gripper support and a partly transverse cross-sectional view taken along the line IV—IV in FIG. 3.

The illustrated forging manipulator comprises a travelling frame or carriage 2 which is formed by two side walls 1 and transverse braces (not shown) connecting the latter and which is movable by wheels 3 on rails 4. Bearings 5, which receive a front rocker shaft 6 and a rear rocker shaft 7, are secured to the side walls 1. Two rocking levers 8 secured to the front rocker shaft 6 and two rocking levers 9 secured to the rear rocker shaft 7 are connected together by links 10 and are thus moved uniformly and in the same direction by pistons 11 which engage the rear rocking levers 9 and which move in double-acting cylinders 13 secured to the side walls 1 by brackets 12. Front connecting rods 14 are connected to the front rocking levers 8 and rear connecting rods 15 are connected to the rear rocking levers 9 by way of ball-and-socket joints 16. The pairs of front connecting rods 14 and rear connecting rods 15 support—as explained in greater detail below—a gripper carrier 17 with a gripper head 18 and clamping jaws 19. The gripper carrier 17 with the gripper head 18 and clamping jaws 19 can be raised and lowered by the piston-cylinder units 11/13 by way of the rocking levers 8 and 9, the links 10 and the connecting rods 14 and 15.

As shown in detail in FIGS. *2a* and *2b*, the connecting rods 14 are continuous with piston rods 20 and the connecting rods 15 are continuous with piston rods 21, and in each case a piston 22 on the piston rod 20 forms with a cylinder 23 a single acting piston-cylinder unit 22/23 and a piston 24 on the piston rod 21 forms with a cylinder 25 a double-acting piston-cylinder unit 24/25. The cylinders 23 and 25 are divided in two, the joint being bridged by a double-acting stuffing box 26 with packing rings, and the two cylinder parts are connected by screws and nuts (not shown). The lower ends of the cylinders 23 and 25 are sealed by stuffing boxes 27 relative to the piston rods 20 and 21 respectively, on which the cylinders 23 and 25 are guided.

Figure 5:
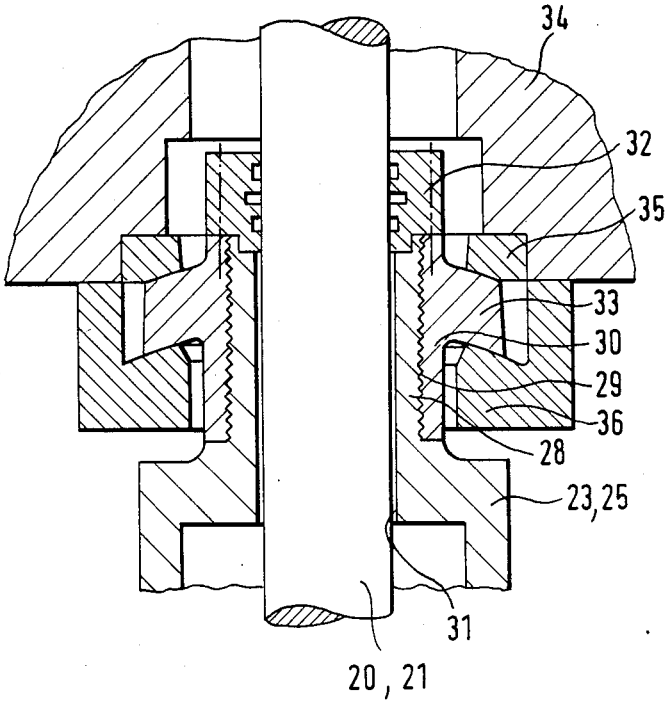
FIG. 5 is a view similar to FIG. 2*a* on a further enlarged scale of only a part thereof.

The design of the tops of the cylinder 23 and 25 is shown on an enlarged scale in FIG. 5. The cylinders 23 and 25 are provided with a neck 28, on which a thread 29 is cut and onto which a threaded sleeve 30 is screwed. The upper cylinder end with the neck 28 is provided with a bore 31 for the passage of the piston rod 20 or 21, which is continued as the connecting rod 14 or 15. A closure ring 32, which is provided with seals and which is mounted on the threaded sleeve 30 and is connected to the latter by screws, is used for guiding the cylinder 23 or 25 at the top and for sealing it relative to the piston rod 20 or 21, respectively. The threaded sleeve 30 is provided with a spherical collar 33, on which an end piece 34 of a cross arm is supported by way of an interposed ball socket 35 which is centered in a bore in the end piece 34. A screw collar ring 36 engages under the spherical collar 33 of the threaded sleeve 30 with a corresponding spherical support surface. The screw collar ring 36 is connected to the end piece 34 by screws (not shown).

The end pieces 34 are associated with cross arms 37 and 38, the cross arm 37 with its end pieces 34 being associated with the front connecting rods 14 and the cross arm 38 with its end pieces 34 being associated with the rear connecting rods 15. The cross arm 37 supports a front bearing housing 39 and the cross arm 38 supports a rear bearing housing 40. The bearing housings 39 and 40 are connected to one another by a spacer tube 41 and are provided with bearings 42 in which the gripper carrier 17 is rotatable by an hydraulic motor 43 and pinions 44 driving a toothed rim 45 connected to the gripper carrier 17. Brackets 46 are firmly connected to the cross arms 37 and 38 as supports for cross cylinders 47. Pistons 48 mounted in the cylinders 47 are provided for the displacement of the bearing housing 39 along its cross arm 37 or of the bearing housing 40 along its cross arm 38 respectively. The cross arms 37 and 38 with their end pieces 34 are guided between the side walls 1, for which purpose the end pieces 34 are provided with bores into which buffer members 49 loaded by springs are inserted.

The end pieces 34 constitute connection means between the respective ends or each cross arm and the associated connecting rod, and more specifically the telescopic piston and cylinder assembly integrated with the connecting rod. The connection means, or end pieces 34, are disposed at a level higher than the lower ends of the telescopic piston and cylinder units, and are disposed about the respective telescopic piston and cylinder units and the associated connecting rods. Thus, the connection means are disposed at that end of each piston and cylinder unit from which the piston rod thereof projects, and are connected to the respective cylinders of said units.

The pistons 22 in the cylinders 23 can be acted upon at one end from above by pressure fluid, in particular hydraulic fluid, with an adjustable pressure from a pressure reservoir, so that vertical spring loading of the gripper carrier 17 under the forging pressure is possible. The pistons 24 in the cylinders 25 can be acted upon at both ends and the cylinder chambers can be blocked, so that the inclination of the gripper carrier 17 can be set.

The gripper carrier 17 is held in a resiliently yielding manner in the axial direction by its swinging suspension on the connecting rods 14 and 15 connected to the piston-cylinder units 50 acting between the front cross arm 37 and the rocker shaft 7.

I claim:

1. In a manipulator including a travelling frame, a gripper with a head, bearings supported on the travelling frame by connecting rods, a gripper carrier rotatably supported in the bearings, the connecting rods being constructed as telescopic piston-cylinder units, a front pair of piston-cylinder units being adjacent the gripper head and adapted for vertical springing and a rear pair of piston-cylinder units being adapted for setting the inclination of the gripper carrier, a ball-and-socket joint at one end of the piston-cylinder units vertically displaceable and connected to levers pivotably mounted in the travelling frame, cross arms connected to the piston cylinder units and supporting the bearings of the gripper carrier so that the gripper carrier with its bearings is horizontally displaceable on the cross arms, the improvement wherein:

the cross arms, which support the bearings for the gripper carrier, are disposed above the bearings in the respective median plane of the bearings.

2. A forging manipulator as claimed in claim 1 wherein:

said cross arms are connected to respective integrated piston and cylinder units by means provided on said cross arms which encircle respective connecting rods.

3. A forging manipulator comprising:

a mobile carriage;

a gripper carrier supported adjustably in said carriage;

front and rear bearings supporting the gripper carrier for rotation of the carrier about a substantially horizontal axis extending longitudinally of the gripper carrier and of the carriage;

a front cross arm suspending said front bearing and extending horizontally above said front bearing transversely to said axis;

a front pair of upright connecting rods suspending the front cross arm and disposed respectively on opposite sides of said gripper carrier, each front connecting rod comprising a telescopic assembly and providing for vertical springing of said gripper carrier;

a rear cross arm suspending said rear bearing and extending horizontally above said rear bearing transversely to said axis;

a rear pair of upright connecting rods suspending said rear cross arm disposed respectively on opposite sides of said gripper carrier;

each rear connecting rod comprising a telescopic assembly and providing for adjusting the inclination of said gripper carrier;

means for moving said bearings along said cross arms, respectively;

means for raising and lowering said connecting rods relative to said carriage; and means for rotating said gripper carrier in said bearings.

4. The manipulater as claimed in claim 3 wherein: said front and rear cross arms are disposed respectivley in the median planes of said front and rear bearings.

5. The manipulator as claimed in claim 3 wherein: each telescopic assembly comprises a pressure-fluid-actuated piston-cylinder unit.

6. A forging manipulator as claimed in claim 5 and further comprising for each said piston and cylinder unit: connection means between said unit and the cross arm associated therewith, said connection means extending about said unit.

7. A forging manipulator as claimed in claim 5 and further comprising for each said piston and cylinder unit:

connection means between said unit and the cross arm associated therewith, each unit having an end from which a piston rod projects, said connection means being disposed at said end of said unit from which said piston rod projects and being connected to the cylinder thereof.

8. A forging manipulator as claimed in claim 5 wherein: each piston-cylinder unit comprises a piston rod which forms an extension of the respective connecting rod;

a piston is provided on each connecting rod; and a cylinder is provided for and traversed in guiding relationship by each piston rod and in cooperating relationship with a respective piston, said cylinders supporting respective cross arms and being disposed below said respective cross arms.

9. A forging manipulator as claimed in claim 8 wherein:

each cylinder is provided with a spherical collar;

an end piece is provided on each end of a respective cross arm;

a ball socket means is provided on each end piece in cooperating relationship with a respective spherical collar;

a bore is provided in each end piece; and each piston rod is extended to form a respective connecting rod extending through said bore in a respective end piece with clearance therebetween.

10. A forging manipulator as claimed in claim 3 and further comprising:

connection means between said front and rear cross arms and respective telescopic assemblies disposed at a level higher than the lower ends of said respective telescopic assemblies for suspending each cross arm on respective connecting rods.

11. A forging manipulator as claimed in claim 10 wherein:

each connecting means is disposed about the respective telescopic assembly.

12. A forging manipular as claimed in claim 3 and further comprising:

connecting means suspensively connecting each said cross arm at each end thereof to a respective connecting rod, each said connecting means being connected to and encircling the said respective connecting rod.

* * * * *